US009217240B2

(12) United States Patent
Shibata

(10) Patent No.: US 9,217,240 B2
(45) Date of Patent: Dec. 22, 2015

(54) WORK VEHICLE, WORK VEHICLE DISPLAY DEVICE, METHOD OF CONTROLLING WORK VEHICLE DISPLAY DEVICE, BACKHOE LOADER, BACKHOE LOADER DISPLAY DEVICE, AND METHOD OF CONTROLLING BACKHOE LOADER DISPLAY DEVICE

(75) Inventor: Takehiro Shibata, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 185 days.

(21) Appl. No.: 14/112,121

(22) PCT Filed: Feb. 27, 2012

(86) PCT No.: PCT/JP2012/054825

§ 371 (c)(1),
(2), (4) Date: Jan. 2, 2014

(87) PCT Pub. No.: WO2012/176499

PCT Pub. Date: Dec. 27, 2012

(65) Prior Publication Data

US 2014/0190046 A1 Jul. 10, 2014

(30) Foreign Application Priority Data

Jun. 24, 2011 (JP) ..... 2011-140353

(51) Int. Cl.

| | |
|---|---|
| ***B60K 26/00*** | (2006.01) |
| ***E02F 9/26*** | (2006.01) |
| ***E02F 3/96*** | (2006.01) |

(Continued)

(52) U.S. Cl.
CPC . *E02F 9/26* (2013.01); *E02F 3/964* (2013.01); *E02F 9/166* (2013.01); *E02F 9/2012* (2013.01); *E02F 9/264* (2013.01)

(58) Field of Classification Search
USPC ..... 180/321, 326, 329, 330; 701/50
See application file for complete search history.

(56) References Cited

U.S. PATENT DOCUMENTS

| | | | | | |
|---|---|---|---|---|---|
| 4,869,337 | A | * | 9/1989 | Wagner | B60N 2/143 180/330 |
| 4,934,462 | A | * | 6/1990 | Tatara | E02F 9/2004 172/2 |
| 5,052,512 | A | * | 10/1991 | Pakosh | B60N 2/143 180/326 |

(Continued)

FOREIGN PATENT DOCUMENTS

| | | | |
|---|---|---|---|
| CN | 2746002 | Y | 12/2005 |
| JP | 2007-270558 | A | 10/2007 |

(Continued)

OTHER PUBLICATIONS

International Search Report dated May 29, 2012, issued for PCT/JP2012/054825.

*Primary Examiner* — Toan To
(74) *Attorney, Agent, or Firm* — Locke Lord LLP

(57) ABSTRACT

A work vehicle including a first work machine and a second work machine, includes: a seat for which an orientation position toward the first work machine and an orientation position toward the second work machine can be switched; a seat position detection unit configured to detect the orientation position of the seat; a display unit configured to display information related to an operation state of the work vehicle; and a control unit configured to change information displayed by the display unit according to the orientation position of the seat detected by the seat position detection unit.

13 Claims, 10 Drawing Sheets

(51) Int. Cl.
*E02F 9/16* (2006.01)
*E02F 9/20* (2006.01)

(56) References Cited

U.S. PATENT DOCUMENTS 5,664,909 A * 9/1997 Lindgren ..... E01C 19/26 180/326
6,643,577 B1 * 11/2003 Padgett ..... E02F 9/166 172/2
6,694,240 B1 * 2/2004 Swick ..... E02F 9/166 701/50
6,711,839 B1 * 3/2004 Kawamura ..... B62D 33/06 180/89.13
7,036,248 B2 * 5/2006 Meyeres ..... E02F 9/2025 172/2
7,374,004 B2 * 5/2008 Kraimer ..... B60K 1/04 180/65.1
7,681,686 B1 * 3/2010 Klas ..... B60K 26/00 180/329
7,784,581 B1 8/2010 Klas et al.
8,041,485 B2 * 10/2011 Prasetiawan ..... E02F 9/166 180/330
8,210,613 B2 * 7/2012 Adelsperger ..... B60N 2/14 297/344.21
2004/0128867 A1 7/2004 Bates
2006/0144634 A1 * 7/2006 Portscheller ..... B60N 2/143 180/330

FOREIGN PATENT DOCUMENTS

JP 2008-019684 A 1/2008
JP 2009-243073 A 10/2009

* cited by examiner

WORK VEHICLE, WORK VEHICLE DISPLAY DEVICE, METHOD OF CONTROLLING WORK VEHICLE DISPLAY DEVICE, BACKHOE LOADER, BACKHOE LOADER DISPLAY DEVICE, AND METHOD OF CONTROLLING BACKHOE LOADER DISPLAY DEVICE

FIELD

The present invention relates to a work vehicle provided with a plurality of work machines within one vehicle body and provided with a display device for displaying information related to an operation state of the work vehicle in a driver's seat of the work vehicle, a work vehicle display device, a method of controlling a work vehicle display device, a backhoe loader, a backhoe loader display device, and a method of controlling a backhoe loader display device.

BACKGROUND

A conventional backhoe loader, which is provided with a work machine (hereinafter, a loader) for conveying earth and sand anterior to a vehicle body and a work machine (hereinafter, a backhoe) for excavating earth and sand posterior to the vehicle body and is capable of traveling by driving tires when working with the loader, has been known. In such a backhoe loader, a seat in which an operator sits is disposed in the driver's cab provided in a central part of the vehicle body, and the orientation of the seat can be revolved anteriorly and posteriorly to the vehicle body. That is, when a work with the loader is performed, the orientation of the seat is set anteriorly to the vehicle body; and when a work with the backhoe is performed, the orientation of the seat is set posteriorly to the vehicle body. Accordingly, the operator can perform various works by operating an operation unit such as an operation lever (Patent Literature 1).

In this way, the backhoe loader enables a work with the loader and a work with the backhoe with a single work vehicle, and there is a backhoe loader provided with a work machine operation lever along with the seat in a swingable manner, so that the workability is improved (Patent Literature 2).

Among the work vehicles provided with a plurality of work machines (for example, a backhoe loader described above), there is one in which a pointer-type monitor 100 illustrated in FIG. 10 is disposed at a position visually recognizable by the operator in the vicinity of the seat in the driver's cab. An engine speed meter 101, an engine water temperature gauge 102, a fuel gauge 103, a service meter 104, a caution 105, and the like are arranged in the pointer-type monitor 100. Instruments, operation switches, and operation buttons that are not housed in the pointer-type monitor 100 are dotted and arranged in the driver's cab.

CITATION LIST

Patent Literature

Patent Literature 1: U.S. Pat. No. 7,784,581

Patent Literature 2: Japanese Patent Application Laid-open No. 2008-019684 A

SUMMARY

Technical Problem

By the way, in the work vehicle having a plurality of the above-described work machines and provided with the pointer-type monitor 100, a work is independently performed in each work machine. In this case, while information that is not necessary in one work (a loader work or a backhoe work) is displayed in the pointer-type monitor 100, necessary information may not be displayed. Here, the necessary information for the operator is information commonly necessary in the works (for example, information of the amount of fuel remaining indicated by the fuel gauge 103) and information uniquely necessary in each work (for example, information of an oil temperature of a torque converter that drives for traveling of the work vehicle when working with the loader). However, in the information displayed in the pointer-type monitor 100, the information necessary in the loader work and the information necessary in the backhoe work are mixed. Therefore, the operator needs to visually find out and confirm where the information necessary in any one of the works (the loader work or the backhoe work) is in the driver's cab (which pointer-type monitor 100 or which location in other instruments), and this confirmation. operation may be troublesome.

In addition, since the plurality of instruments such as the pointer-type monitor 100, other instruments, and the operation switches is provided in the driver's cab of the work vehicle, the residence space in the driver's cab needs to be narrowed, and the view is blocked when looking over a working site outside the driver's cab through a glass that constitutes the driver's cab, and the workability of the operator is impaired.

Further, if such a plurality of instruments is provided, the number of parts is, of course, increased, and a number of assembly processes for assembling the parts in the driver's cab is required, which impacts on the cost.

To address the problem, if a lot of information necessary in each work is attempted to be displayed in a single display device, the display size for displaying each piece of information becomes small, and the visibility is decreased. Meanwhile, if the visibility of the information is attempted to be maintained, the display device needs to be larger. As a result, the residence space in the driver's cab is narrowed and the livability is degraded, and a harmful effect is caused, in which the view is blocked when overlooking the working site outside the driver's cab through the glass that constitutes the driver's cab, whereby the workability of the operator is impaired.

The present invention has been made in view of the foregoing, and an objective is to provide a work vehicle, a work vehicle display device, a method of controlling a work vehicle display device, a backhoe loader, a backhoe loader display device, and a method of controlling a backhoe loader display device which are applicable to a work vehicle having a plurality of work machines, are capable of maintaining the visibility of information necessary when working with each work machine, and are achieving downsizing of the display device.

Solution to Problem

To overcome the problems and achieve the object, according to the present invention, a work vehicle including a first work machine and a second work machine, comprises: a seat for which an orientation position toward the first work machine and an orientation position toward the second work machine can be switched; a seat position detection unit configured to detect the orientation position of the seat; a display unit configured to display information related to an operation state of the work vehicle; and a control unit configured to change information displayed by the display unit according to the orientation position of the seat detected by the seat position detection unit.

According to the present invention, the information displayed by the display unit is individual information that is different between when a work is performed with the first work machine and when a work is performed with the second work machine, and the control unit is configured to switch the individual information according to the orientation position of the seat detected by the seat position detection unit.

According to the present invention, the individual information is first individual information related, to a work by the first work machine displayed in the display unit when the seat position detection unit detects that the seat is in the orientation position toward the first work machine, or second individual information related to a work by the second work machine displayed in the display unit when the seat position detection unit detects that the seat is in the orientation position toward the second work machine.

According to the present invention, when the orientation position detected by the seat position detection unit is not the orientation position toward the first work machine and is not the orientation position toward the second work machine, the control unit displays, in the display unit, any of the first individual information, the second individual information, and other information different from the first individual information and the second individual information.

According to the present invention, at least one of the first individual information and the second individual information is information indicating a physical amount that is changed according to an operation of a power transmission mechanism of the work vehicle, or information indicating a setting state of a steering system of a traveling body included in the work vehicle.

According to the present invention, the individual information is displayed in a central part of a display screen that is included in the display unit.

According to the present invention, the information displayed by the display unit includes common information displayed in the display unit commonly when a work is performed with the first work machine and when a work is performed with the second work machine.

According to the present invention, the seat position detection unit is configured to detect the orientation position of the seat by detecting a revolving position of the seat or a backrest position of the seat.

According to the present invention, a work vehicle display device comprises: a display unit configured to display information related to an operation state of a work vehicle in which a first work machine and a second work machine are arranged, the work vehicle including a seat for which an orientation position toward the first work machine and an orientation position toward the second work machine can be switched; and a control unit configured to change information displayed by the display unit according to a seat position detected by a seat position detection unit configured to detect the orientation position of the seat.

According to the present invention, a method of controlling a work vehicle display device including a display unit configured to display information related to an operation state of a work vehicle in which a first work machine and a second work machine are arranged, the work vehicle including a seat for which an orientation position toward the first work machine and an orientation position toward the second work machine can be switched, the method comprises: a seat position detection step of detecting the orientation position of the seat; and a control step of changing information displayed by the display unit according to the orientation position detected by the seat position detection step.

According to the present invention, a backhoe loader provided with a loader and a backhoe, comprises: a seat for which an orientation position toward the loader and an orientation position toward the backhoe can be switched; a seat position detection unit configured to detect the orientation position of the seat; a display unit configured to display information related to an operation state of the backhoe loader; and a control unit configured to change information displayed by the display unit according to the orientation position of the seat detected by the seat position detection unit.

According to the present invention, a backhoe loader display device comprises: a display unit configured to display information related to an operation state of a backhoe loader in which a loader and a backhoe are arranged, the backhoe loader including a seat for which an orientation position toward the loader and an orientation position toward the backhoe can be switched, and a control unit configured to change information displayed by the display unit according to a seat position detected by a seat position detection unit configured to detect the orientation position of the seat.

According to the present invention, a method of controlling a backhoe loader display device including a display unit configured to display information related to an operation state of a backhoe loader in which a loader and a backhoe are arranged, the backhoe loader including a seat for which an orientation position toward the loader and an orientation position toward the backhoe can be switched, the method comprises: a seat position detection step of detecting the orientation position of the seat; and a control step of changing information displayed by the display unit according to the orientation position detected by the seat position detection step.

Advantageous Effects of Invention

According to the present invention, information displayed by a display unit is changed according to an orientation position of a seat in a work vehicle, in which a first work machine and a second work machine are arranged and which includes the seat for which an orientation position toward the first work machine and an orientation position toward the second work machine can be switched. Therefore, the visibility of information necessary in a work with each work machine can be improved using the same display unit, and downsizing of the display device can be achieved.

Further, according to the present invention, information displayed by a display unit is changed according to an orientation position of a seat in a backhoe loader, in which a loader and a backhoe are arranged and which includes the seat for which an orientation position toward the loader and an orientation position toward the backhoe can be switched. Therefore, the visibility of information necessary in respective works with the loader and with the backhoe can be improved using the same display unit, and the downsizing of the display device can be achieved.

DESCRIPTION OF EMBODIMENTS

Hereinafter, a work vehicle, a work vehicle display device, and a method of controlling a work vehicle display device, to be specific, a backhoe loader, a backhoe loader display device, and a method of controlling a backhoe loader display device that are an embodiment of the present invention will be described with reference to the drawings. Note that, in the following description, the same or corresponding components are denoted by the same reference signs. In addition, the present invention is not limited by the following embodiment.

(Outline of Work Vehicle)

Figure 1:
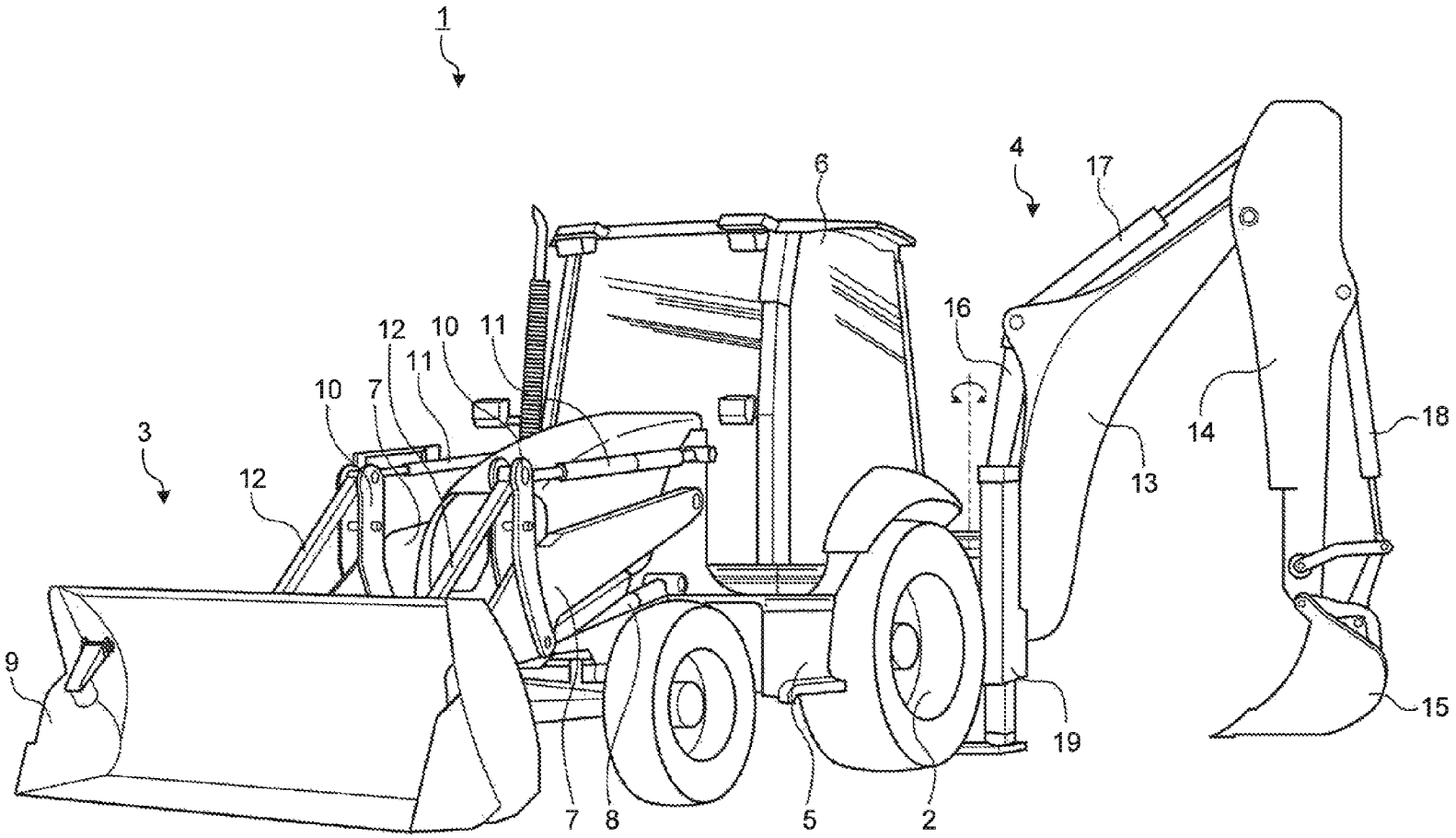
FIG. 1 is a perspective view illustrating a work vehicle that is an embodiment of the present invention.

FIG. 1 is a perspective view illustrating a work vehicle that is an embodiment of the present invention. As illustrated in FIG. 1, a backhoe loader 1 that is a work vehicle is provided with a lower traveling body 2 including tires and the like, a loader 3 that is a first work machine, a backhoe 4 that is a second work machine, a frame part 5, and a driver's cab 6.

The loader 3 is provided with a lift arm 7. The lift arm 7 is attached to the frame part 5 having a base end part in a freely swingable manner. The frame part 5 and the lift arm are coupled by a pair of lift cylinders 8. The lift arm 7 swings due to extension and contraction of the lift cylinders 8 in response to an operation of a work machine lever, by the operator. A bucket 9 is attached to a tip part of the lift arm 7 in a freely swingable manner. In addition, the loader 3 is provided with a bell crank 10. The bell crank 10 is supported at an approximately central part of the lift arm 7 in a freely turnable manner. One end part of the bell crank 10 and the frame part 5 are coupled via a tilt cylinder 11. The other end part of the bell crank 10 and the bucket 9 are coupled via a tilt rod 12. The bucket 9 swings due to extension and contraction of the tilt cylinder 11 in response to an operation of the work machine lever by the operator in addition, in a loader work by the loader 3, the backhoe loader 1 can travel. The backhoe loader 1 is provided with a torque converter for transmitting a driving force of an engine to the tires of the lower traveling body 2 as a power transmission mechanism. The loader work can be performed using the above-described loader 3, in which the bucket 9 is loaded with earth and sand and the lower traveling body 2 is driven, so that the backhoe loader 1 is moved and the earth and sand are loaded on a dump truck.

The backhoe 4 is provided with a boom 13 having a base end part thereof coupled with the frame part 5 in a freely turnable and swingable manner, an arm 14 coupled with a tip part of the boom 13 in a freely swingable manner, and a bucket 15 coupled with a tip of the arm 14 in a freely swingable manner. The frame part 5 and an approximately central part of the boom 13 are coupled via a boom cylinder 16. The boom 13 swings due to extension and contraction of the boom cylinder 16 in response to an operation of the work machine lever by the operator. In addition, the boom 13 can turn (swing) in right and left directions of the vehicle body by a boom swing cylinder (not illustrated) coupled with the frame part 5 and a base end part of she boom 13. The boom 13 turns (swings) in the right and left directions of the vehicle body due to extension and contraction of the boom swing cylinder in response to an operation of the work machine lever by the operator. Further, a coupled part of the boom 13 and the frame part 5 has a structure in which the coupled part can move in the right and left directions of the vehicle body. That is, an excavation portion can be moved without moving the vehicle body by moving the coupled part right and left. The approximately central part of the boom 13 and a base end part of the arm 14 are coupled via an arm cylinder 17, The arm 14 swings due to extension and contraction of the arm cylinder 17 in response to an operation of the work machine lever by the operator. The base end part of the arm 14 and the bucket 15 are coupled via a bucket cylinder 18. The bucket 15 swings due to extension and contraction of the bucket cylinder 18 in response to an operation of the work machine lever by the operator. Further, a pair of stabilizers 19 are provided right and left with respect to the vehicle body at the backhoe 4 side of the frame part 5. The stabilizers 19 are extended in response to an operation of a stabilizer operation lever 36 by the operator when a work is performed using the backhoe 4, and fix the backhoe loader 1 on the ground. A backhoe work can be performed using such the backhoe 4, in which the earth and sand and the like are excavated with the bucket 15 and a groove is formed, for example.

Figure 2:
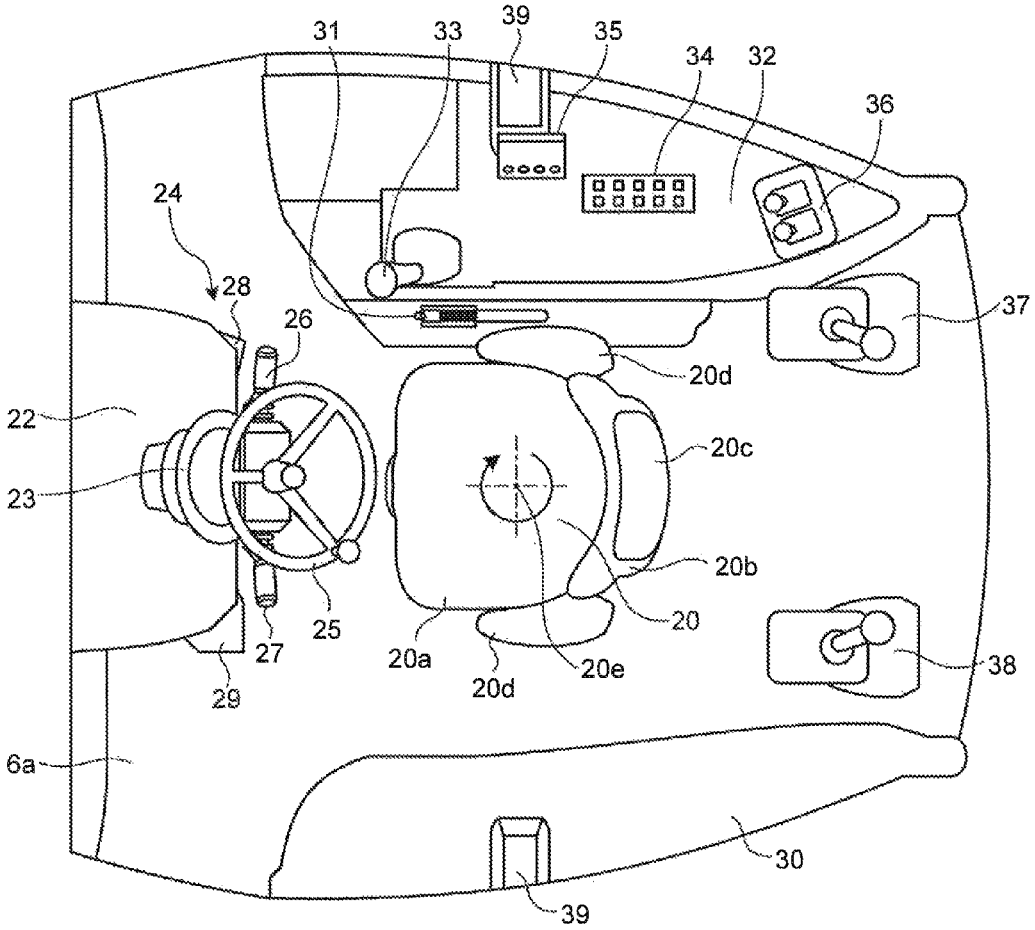
FIG. 2 is a top view illustrating an interior of a driver's cab of the work vehicle illustrated in FIG. 1.
Figure 3:
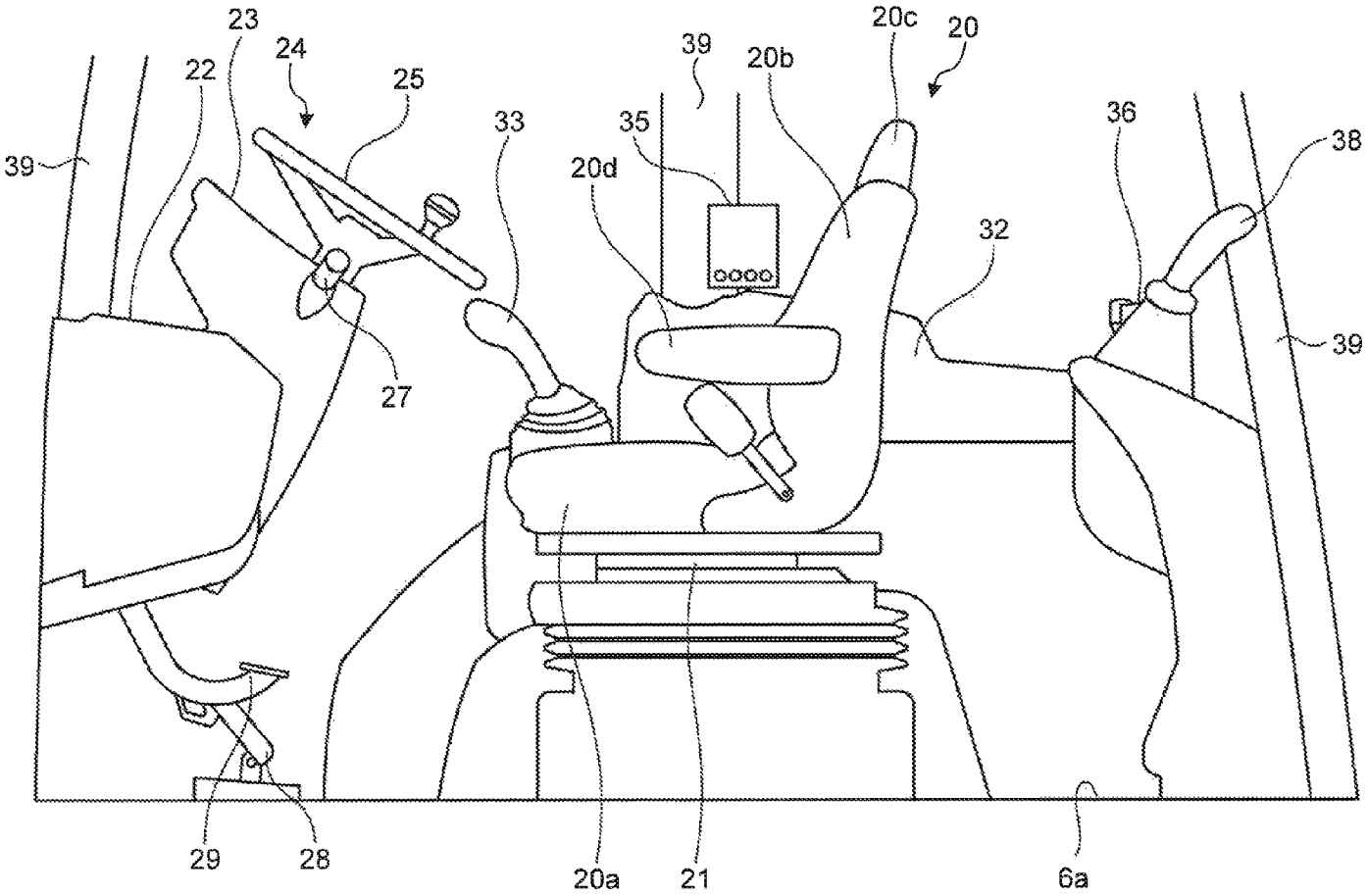
FIG. 3 is a side view illustrating the interior of the driver's cab of the work vehicle illustrated in FIG. 1.

Next, an inner structure of the driver's cab 6 will be described. FIGS. 2 and 3 are a top view and a side view, respectively, illustrating inner structures of the driver's cab 6. As illustrated in FIGS. 2 and 3, the driver's cab 6 is provided with a seat 20 on a central part on a floor 6*a*. The seat 20 includes a seat surface 20*a*, a backrest 20*b* provided above the seat surface 20*a*, a headrest 20*c* provided above the backrest 20*b*, and armrests 20*d* provided at both side parts of the backrest 20*b*. A revolving part 21 as illustrated in FIG. 3 is provided under this seat 20, and the seat 20 is made in a manner half-revolvable around a revolving shaft 20*e* of the seat 20. According to the seat 20 having such a structure, the operator performs a release operation of a revolving rock mechanism (not illustrated) of the seat 20, so that the seat 20 can change an orientation position to an orientation position toward the loader 3 anterior to the vehicle body (in a left direction in FIGS. 2 and 3) and to an orientation position toward the backhoe 4 posterior to the vehicle body (in a right direction in FIGS. 2 and 3). That is, FIG. 2 illustrates a state in which the seat 20 is set in the orientation position toward the loader 3.

(1) A Case Where the Seat 20 is Set in the Orientation Position Toward the Loader 3

An instrument panel 22 provided with various gauges, a first work machine gauge board 23 including a loader gauge board that displays an operation state of the loader 3, and a traveling operation unit 24 facing the loader 3 side and for a traveling operation of the backhoe loader 1 are provided anterior to the seat 20. The first work machine gauge board 23 is provided with a speed meter that indicates a speed of the backhoe loader 1 when traveling, and the like. That is, information that needs to be recognized without requiring a large movement of the operator's view when working with the loader is displayed on the first work machine gauge board 23. Meanwhile, the traveling operation unit 24 includes a steering wheel 25 that steers the tires of the lower traveling body 2 and determines the swing direction, a direction indicating lever 26 that indicates the swing direction, a gear shift lever 27 that shifts a gear, an accelerator pedal 28, and a brake pedal 29. In addition, a side console 30 is disposed at a left lateral part of the seat 20 (at a lower side in FIG. 2 and at a front side in FIG. 3).

In addition, a hand brake lever 31 that fixes and brakes the lower traveling body 2 when the vehicle stops and a side console 32 are provided at a right lateral part (at an upper side in FIG. 2 and at an inner side in FIG. 3) in a case where the seat 20 is in the orientation position toward the loader 3 (in the left direction in FIGS. 2 and 3). The side console 32 is provided with a first work machine lever 33 for operating the loader 3 and an instrument group 34 in which various gauges, switches, and buttons are provided. A display device 35 that functions as a multi-monitor is provided in a pillar 39 at a lateral part of the seat 20. The first work machine lever 33 is an operation lever used for performing an operation of the loader 3, such as an up and down motion of the lift arm 7 and turning of the bucket 9.

(2) A Case Where the Seat 20 is Set in the Orientation Position Toward the Backhoe 4

The stabilizer operation lever 36 provided in the side console 32 is provided left anterior to the seat 20 (in an upper right side in FIG. 2, and in a right inner side in FIG. 3). Second work machine levers 37 and 38 are provided anterior to the seat 20 (right side in FIGS. 2 and 3). The operator operates the stabilizer operation lever 36, so that extension of the stabilizer 19 can be performed. The second work machine levers 37 and 38 are operation levers used for operations of the backhoe 4, such as turning and swinging of the boom 13 (an up and down motion) and swinging of the arm 14 and the bucket 15.

Figure 4:
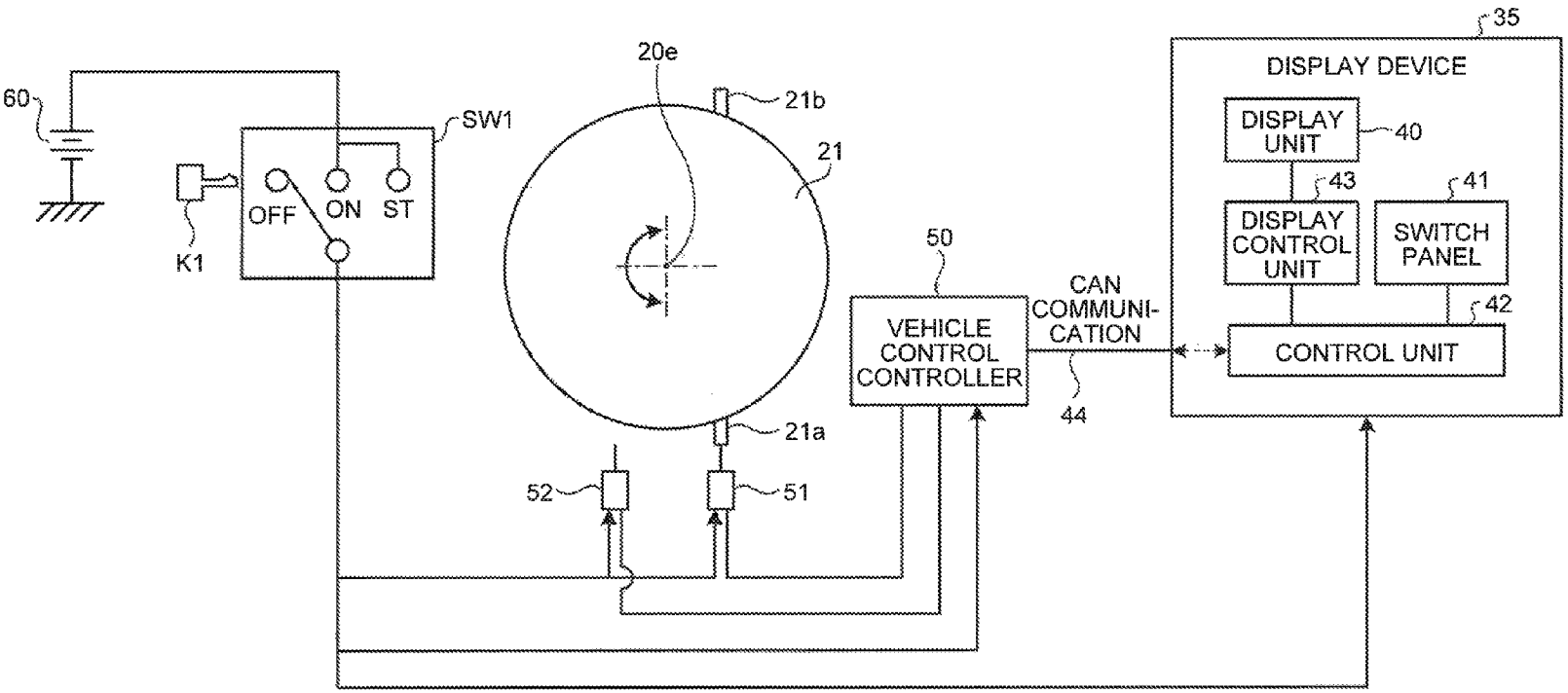
FIG. 4 is a block diagram illustrating a configuration of a display control system of a display device illustrated in FIGS. 2 and 3.

FIG. 4 is a block diagram illustrating a configuration of the display control system around the above-described display device 35. As illustrated in FIG. 4, the display device 35 includes a display unit 40 as a display unit and a switch panel 41 as an operation unit. As the display unit 40, a liquid crystal display or an organic electroluminescence display is used. The switch panel 41 is operated when switching of various types of information displayed in the display unit 40 and setting of a control parameter related to an operation of the backhoe loader 1 are performed. The switch panel 41 may be integrally incorporated into the display device 35, and may be integrally structured with the display unit 40 using the display unit 40 as a touch panel. In addition, the switch panel 41 may be incorporated into the instrument group 34. In any case, it is favorable to provide the switch panel 41 at a position that the operator who sits on the seat 20 can reach.

The display device 35 further includes a display control unit 43 that performs display control of the display unit 40 under control of a control unit 42. The control unit 42 receives various signals output from a vehicle control controller 50 described below, various signals from various sensors mounted to an engine or hydraulic equipment (not illustrated), and various signals from other controllers. The control unit 42, then, executes determination processing of determining whether information related to the received various signals should be displayed in the display unit 40 through the display control unit 43 or be stored in a storage device such as a memory (not illustrated). In addition, the display control unit 43 executes determination processing of determining in what form the information should be displayed (a display range, display color, display order, display pattern, and the like) in the display unit 40 based on the information related to the various signals received from the control unit 42. Note that the display device 35 is connected to the vehicle control controller 50 through a communication line 44 such as a controller area network (CAN). To be specific, the communication line 44 is connected to the control unit 42, and transmission/reception of the various signals is performed.

The vehicle control controller 50 is connected to a first sensor 51 and a second sensor 52 that are seat position detection unit. The vehicle control controller 50 detects and determines in which orientation position the seat 20 is, as described below using FIG. 5. In addition, to enable a work with either the loader 3 or the backhoe 4 according to the result of the detected orientation. position of the seat 20, the vehicle control controller 50 executes control of a hydraulic circuit of hydraulic equipment (not illustrated) and control for engine output control of the engine. Note that the vehicle control controller 50 does not necessarily perform the control of the hydraulic circuit and the engine output control. A separate controller may be provided and the separate controller may execute the control.

The first sensor 51 and the second sensor 52 are provided at an outer peripheral side of the revolving part 21 that forms an integral structure with a lower part of the seat 20. In addition, a first protrusion part 21*a* and a second protrusion part 21*b* are provided in a periphery of the revolving part 21. The first sensor 51 and the second sensor 52 electrically detect whether or not the first protrusion part 21*a* or the second protrusion part 21*h* is positioned anterior to each of the sensors. As the first sensor 51 and the second sensor 52, a contactless-type sensor or a contact-type sensor can be applied. As the contactless-type sensor, a laser sensor, a proximity sensor, an ultrasonic sensor, and the like can be used. Meanwhile, if a contact-type sensor is used, a sensor such as a limit switch can be used. In the embodiment of the present invention, an embodiment of using a contact-type sensor (for example, a limit switch) will be described.

Further, FIG. 4 illustrates a state in which the first protrusion part 21*a* is positioned anterior to the first sensor 51, the first protrusion part 21*a* comes in contact with a detection unit of the first sensor 51 so that the first protrusion part 21*a* is detected to be positioned anterior to the first sensor 51, and the first sensor 51 can output an electrical signal of "ON". Note that, in this state, the seat 20 is in the orientation position toward the loader 3. Meanwhile, when the seat 20 is revolved half around the revolving shaft 20*e* and in the orientation position toward the backhoe 4, the revolving part 21 that forms the integral structure with the lower part of the seat 20 is also revolved half (180°). The second protrusion part 21*b* is positioned anterior to the second sensor 52, the second protrusion part 21*b* comes in contact with a detection unit of the second sensor 52 so that the second protrusion part 21*b* is detected to be positioned anterior to the second sensor 52, and the second sensor 52 can output an electrical signal of "ON". In neither of the above states, that is, in a case where neither the detection units of the first sensor 51 nor the second sensor 52 are in contact with either of the first protrusion part 21*a* and the second protrusion part 21*b*, the state in an "OFF" state (in a state where no electrical signal is output).

In addition, the above-described display device 35, the vehicle control controller 50, the first sensor 51, and the second sensor 52 are electrically connected to receive power supply from a battery 60 through a key switch SW1. The battery 60 is a storage battery such as a lead storage battery or nickel-hydrogen battery. Note that the key switch SW1 is a three-point contact type switch (so-called, a starting switch) in which start (restart) of an engine (not illustrated), a driving state of the engine, and stop are switched by inserting and turning a key K1. The key switch SW1 is provided at the side console 32 or the side console 30, for example, and is arranged at a position where the operator who sits on the seat 20 can reach. That is, when the key switch SW1 is at the position of "ST", a starter motor (not illustrated) is driven and the engine is started (restarted). When the key switch SW1 is at the position of "ON", the vehicle is in a state where the power supply from the battery 60 to the display device 35, the vehicle control controller 50, or the first and second sensors 51 and 52 is available, or in an engine driving state after the engine is started (restarted). Further, when the key switch SW1 is at the position of "OFF", the vehicle is in a state where the power supply from the battery 60 to the display device 35, the vehicle control controller 50, or the first and second sensors 51 and 52 is not available, and also the engine is in a stopped state. Note that the key K1 may be a cylinder lock-type key or an electronic key having an immobilizer function. Also, the switch SW1 may be switched by an operation of pressing a push button switch (not illustrated) instead of the turning operation of the key K1 as described above.

(Details of Display Control)

Figure 5:
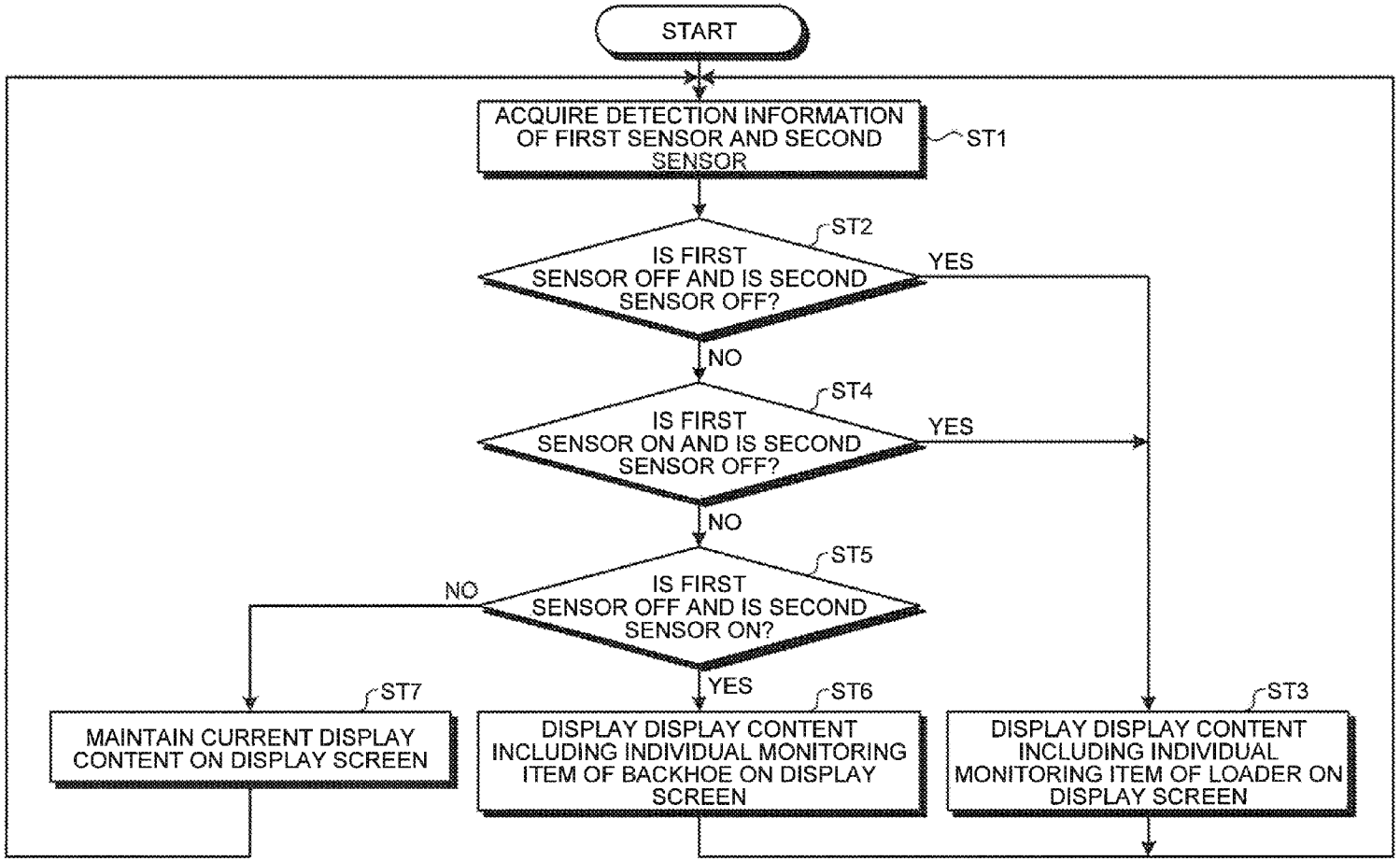
FIG. 5 is a flowchart illustrating a display processing procedure of the display device illustrated in FIGS. 2 and 3.
Figure 6:
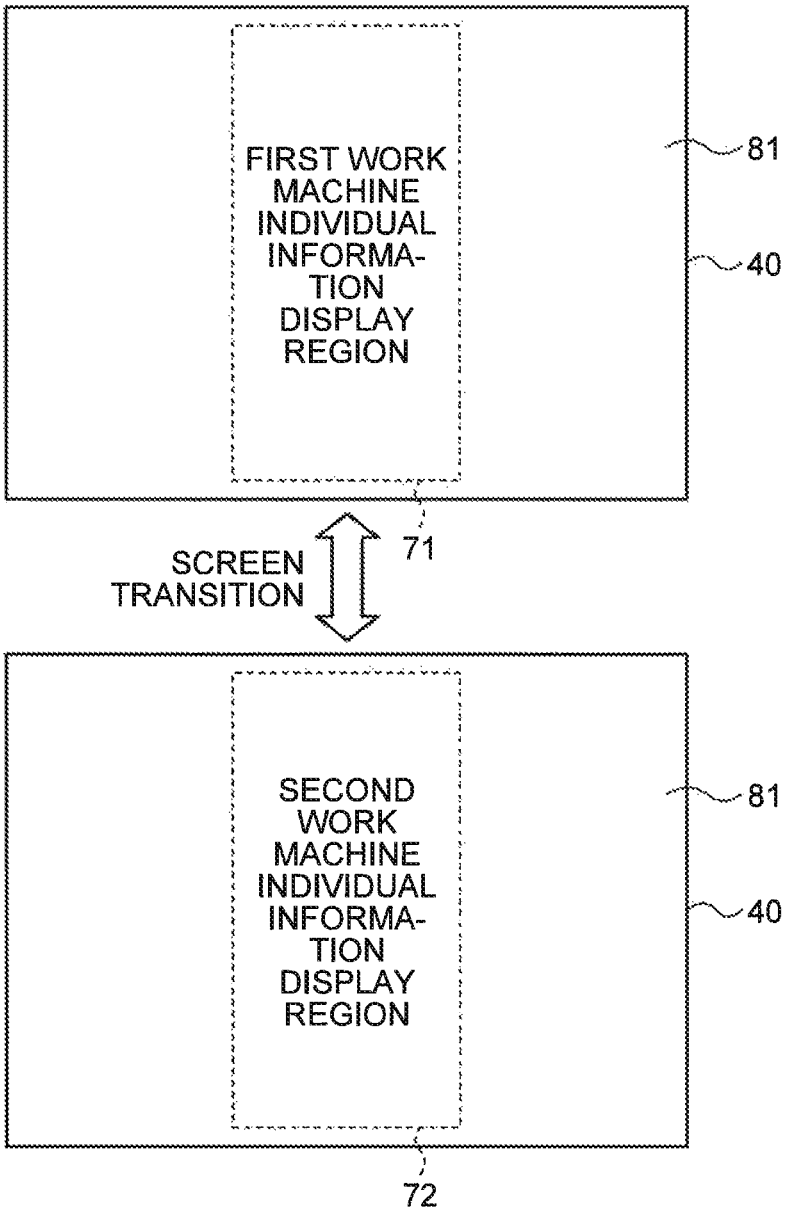
FIG. 6 is a schematic diagram illustrating an example of display region sections of the display device illustrated in FIG. 2 and FIG. 3.

Next, screen transition of the display unit 40 in the display device 35 of the display control system configured as described above will be described. FIG. 5 is a flowchart illustrating a screen display processing procedure of the display device 35. FIG. 6 is a schematic diagram illustrating an example of display region sections in display screen transition of the display device 35.

In FIG. 5, first, the control unit 42 acquires detection information of the first sensor 51 and the second sensor 52 through the vehicle control controller 50 (step ST1). Hereinafter, an expression of the detection information is "ON" means that the first sensor 51 or the second sensor 52 outputs an electrical signal, and an expression of the detection information is "OFF" means that the first sensor 51 or the second sensor 52 does not output an electrical signal. Note that it has been described such that, when the first sensor 51 or the second sensor 52 detects the first protrusion part 21*a* or the second protrusion part 21*b*, the first sensor 51 or the second sensor 52 outputs an electrical signal ("ON"), and when the first sensor 51 or the second sensor 52 does not detect the first protrusion part 21*a* or the second protrusion part 21*b*, the first sensor 51 or the second sensor 52 does not output an electrical signal ("OFF"). However, the relationship of outputs of the "ON" and "OFF" electrical signals from the first sensor 51 and the second sensor 52 may be reversed. That is, it may be configured such that, when the first sensor 51 or the second sensor 52 detects the first protrusion part 21*a* or the second protrusion part 21*b*, the first sensor 51 or the second sensor 52 does not output an electrical signal ("OFF"), and when the first sensor 51 or the second sensor 52 does not detect the first protrusion part 21*a* or the second protrusion part 21*b*, the first sensor 51 or the second sensor 52 outputs an electrical signal ("ON").

Following that, the control unit 42 determines whether the first sensor 51 is "OFF" and the second sensor 52 is "OFF" (step ST2). When both of the first sensor 51 and the second sensor 52 are "OFF" (Yes at step ST2), the seat 20 is determined to be in an orientation position that faces neither the loader 3 nor the backhoe 4, that is, the seat 20 is revolving. In this case, the vehicle control controller 50 transmits information related to the operation state of the loader 3 to the display device 35, and the control unit 42 performs control for displaying the information related to the operation state of the loader 3 in the display unit 40. The information related to the operation state of the loader 3 will be described below in detail, but is display content including an individual. monitoring item, and the display content including the individual monitoring item is displayed on a display screen 81 of the display unit 40 (step ST3). For example, as illustrated in the upper diagram of FIG. 6, the above-described display content of the individual monitoring item related to the loader 3 is displayed in a first work machine individual information display region 71 on the display screen 81. In addition, display content of a common monitoring item related to the operation state of the backhoe loader 1 that is common to the loader 3 and the backhoe 4 is displayed in a region other than the first work machine individual information display region 71 on the display screen 81. Note that the entire display screen 81 may be used as the first work machine individual information display region 71. Note that, since the seat 20 is determined to be revolving as described above, when it is determined to be Yes at step ST2, the control unit 42 outputs, to the display control unit 43, a signal indicating that the seat 20 is revolving in place of step ST3, and the display control unit 43 may cause the display unit 40 to perform display in such a manner that an announcement of "seat revolving" or a request of "please fix the seat" is given to the operator. Such an announcement and a request can be realized by performing control such that character information or symbols that indicate the meaning are displayed in the display unit 40.

Meanwhile, when it is not a state where the first sensor 51 is "OFF" and the second sensor 52 is "OFF" (No at step ST2), the control unit 42 further determines whether the first sensor 51 is "ON" and the second sensor 52 is "OFF" (step ST4). When the first sensor 51 is "ON" and the second sensor 52 is "OFF" (Yes at step ST4), the orientation position of the seat 20 is determined to be the orientation position toward the loader 3. In this case, the vehicle control controller 50 transmits information related to the operation state of the loader 3 to the display device 35, and the control unit 42 performs control for displaying the information related to the operation state of the loader 3 in the display unit 40. The information related to the operation state of the loader 3, which is described in detail below, is display content including an individual monitoring item, and the display content including the individual monitoring item is displayed on the display screen 81 of the display unit 40 (step ST3). For example, as illustrated in the upper diagram of FIG. 6, the above-described display content of the individual monitoring item related to the loader 3 is displayed within the first work machine individual information display region 71 on the display screen 81.

In addition, when it is not a state where the first sensor 51 is "ON" and the second sensor 52 is "OFF" (No at step ST4), the control unit 42 further determines whether the first sensor 51 is "OFF" and the second sensor 52 is "ON" (step ST5). When the first sensor 51 is "OFF" and the second sensor 52 is "ON" (Yes at step ST5), the orientation position of the seat 20 is determined to be the orientation position toward the backhoe 4. In this case, the vehicle control controller 50 transmits information related to the operation state of the backhoe 4 to the display device 35, and the control unit 42 performs control for allowing the display unit 40 to display the information related to the operation state of the backhoe 4. The information related to the operation state of the backhoe 4, which is described in detail below, is display content including an individual monitoring item, and the display content including the individual monitoring item is displayed on the display screen 81 of the display unit 40 (step ST6). For example, as illustrated in the lower diagram of FIG. 6, the above-described display content of the individual monitoring item related to the above-described backhoe 4 is displayed within a second work machine individual information display region 72 on the display screen 81. Further, display content of a common monitoring item related to the operation state of the backhoe loader 1 common to the loader 3 and the backhoe 4 is displayed in a region other than the second work machine individual information display region 72 on the display screen 81. Note that the entire display screen 81 may be used as the second work machine individual information display region 72. Also, note that it is more favorable that the first work machine individual information display region 71 or the second work machine individual information display region 72 is set near the center of the display screen 81.

When the operator switches a loader work and a backhoe work, by revolving the seat 20 as described above, the display screen 81 performs screen transition according to the orientation position of the seat 20 as illustrated in FIG. 6. Therefore, screen transition of a central part of the display screen 81 rather than a corner part allows the operator to promptly and accurately recognize the change of the display content because the screen on which the display content including the individual monitoring item of the loader 3 is displayed and the screen on which the display content including the individual monitoring item of the backhoe 4 is displayed are different at first glance, whereby the workability of the operator is improved.

Meanwhile, when it is not a state where the first sensor 51 is "OFF" and the second sensor 52 is "ON" (No at step ST5), the control unit 42 determines that any of the first sensor 51, the second sensor 52 and the vehicle control controller 50 has been broken down because both of the first sensor 51 and the second sensor 52 are in the "ON" state from the determination results of steps ST2, ST4, and ST5. Then, the control unit 42 does not perform the screen transition processing of the display screen 81, and maintains the screen display of the currently displayed display content (step ST7). In this case, cautions (icons or character information) indicating that the screen display of the currently displayed display content is maintained, and any of the first sensor 51, the second sensor 52, and the vehicle control controller 50 has been broken down are displayed within the display screen 81 so as to notify the operator or the service person of the breakdown. Note that, as the notification unit, a sound producing apparatus may be provided in the display device 35 so that a warning sound is also output.

After the completion of the processing of the above steps ST3, ST6 or ST7, the processing returns to step ST1, and acquisition of the detection information of "ON" or "OFF" in the first sensor 51 and the second sensor 52 is continuously executed.

Note that, when both of the first sensor 51 and the second sensor 52 are "OFF" (Yes at step ST2), the seat 20 is determined to be revolving, and the display content including the individual monitoring item of the loader 3 is displayed on the display screen 81 by default (step ST3). However, the display content including the individual monitoring item of the backhoe 4 may be displayed on the display screen 81.

In addition, the above-described first work machine individual information display region 71 and the second work machine individual information display region 72 have been described on the assumption of a fixed region. However, the regions are not limited to the fixed region, and the size of the display region may be made variable, or the positions of the display regions may be made variable. In a case where a position of the display region is made variable, it is favorable to display the first work machine individual information display region 71 at a position on the loader 3 side (anterior to the vehicle body), and to display the second work machine individual information display region 72 at a position on the backhoe 4 side (posterior to the vehicle body). By displaying the regions in such a manner, the screen on which the display content including the individual monitoring item of the loader 3 is displayed and the screen on which the display content including the individual monitoring item of the backhoe 4 is displayed are different at a first glance, and are excellent in visibility. In addition, the operator works while observing motions of the loader 3 that is the first work machine and of the backhoe 4 that is the second work machine closely when working with the loader or working with the backhoe. Therefore, the operator can reduce movement of the observer's eyes when looking at the individual monitoring item displayed in the first work machine individual information display region 71 or in the second work machine individual information display region 72, whereby the workability can be improved.

(Details of Display Screen)

Figure 7:
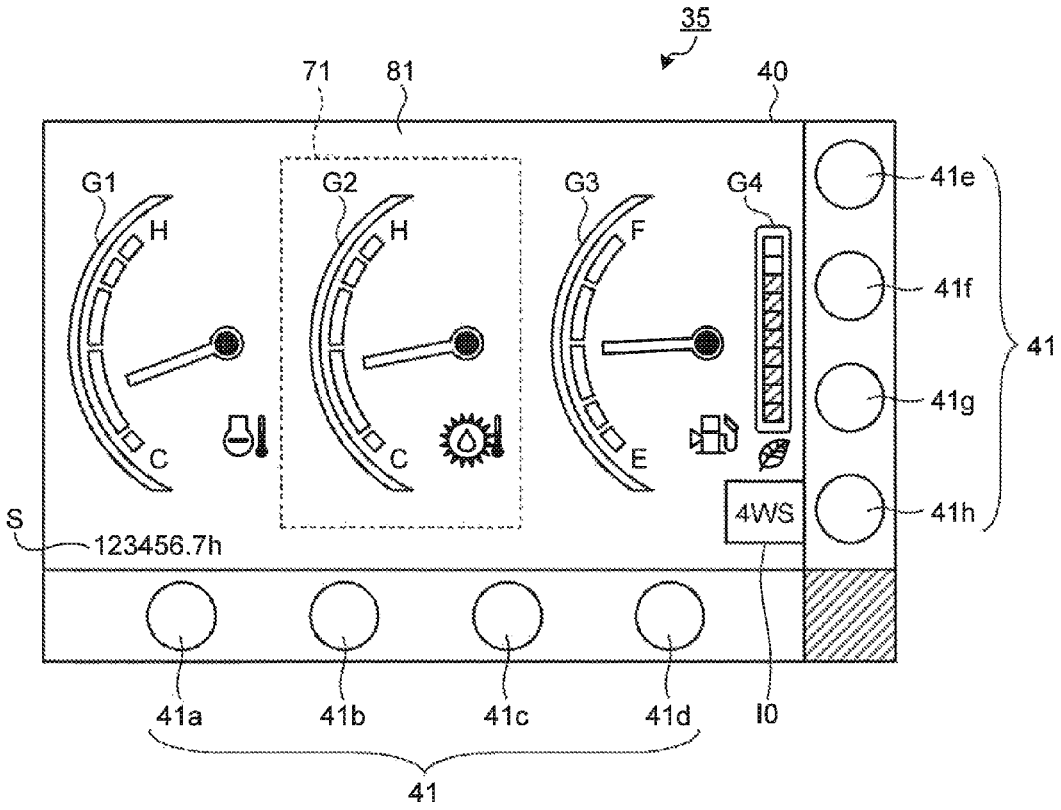
FIG. 7 is a diagram illustrating an example of a display screen of the display device illustrated in FIGS. 2 and 3.
Figure 8:
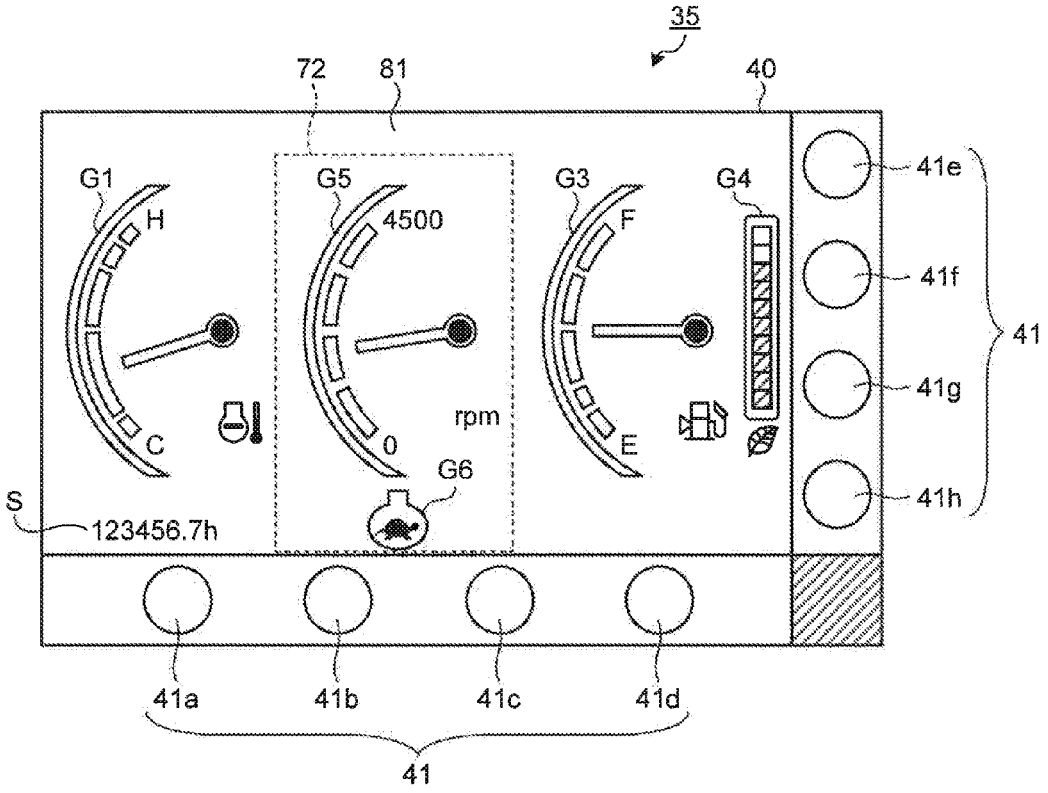
FIG. 8 is a diagram illustrating an example of the display screen illustrated in FIGS. 2 and 3.

Next, the screen transition according to display control processing by the display control unit 43 that operates in response to a signal from the above-described control unit 42 and the control unit 42 will be specifically described. FIGS. 7 and 8 are diagrams illustrating specific examples of the screen transition of the display screen.

FIG. 7 is the display screen 81 when the seat 20 is in the orientation position toward the loader 3. The display screen 81 includes an engine water temperature gauge G1 that indicates a water temperature of cooling water of the engine, a torque converter oil temperature gauge G2 that indicates an oil temperature of a hydraulic oil of a torque converter, and a fuel level gauge G3 that indicates remaining fuel level. Note that, in a loader work as described above, the backhoe loader 1 can travel by driving the lower traveling body 2, and the torque converter oil temperature gauge G2 is displayed on the display screen 81 in order to monitor the temperature of the torque converter hydraulic oil contained in the torque converter that is driven at driving.

In addition, a fuel consumption gauge G4 is also displayed on the right side of the fuel level gauge G3. These gauges are displayed such that pointers of the gauges move based on sensor signals for detecting respective physical amounts sent from sensors. The fuel consumption gauge G4 indicates fuel consumption per unit time in a bar graph. Note that this fuel consumption gauge G4 may be displayed in other forms such as numerical display in place of the bar graph.

In addition, a service meter S is displayed at a lower left part of the display unit 40. The service meter S indicates an accumulated operation time of the backhoe loader 1 in figures. Here, as the common monitoring items related to the operation state of the backhoe loader 1, the engine water temperature gauge G1, the fuel level gauge G3, the fuel consumption gauge G4, and the service meter S are displayed in the display unit 40; and the torque converter oil temperature gauge G2 is displayed in the first work machine individual information display region 71 in which the individual monitoring items related to the operation state of the loader 3 is displayed. Note that the first work machine individual information display region 71 can broaden or narrow the display region according to the type of a monitoring item to be displayed or an operational status of the backhoe loader 1, and furthermore, can display the display region at any position on the display screen 81. For example, as the type of the monitoring item displayed in the first work machine individual information display region 71, a loaded load in the bucket 9 (a load loaded each time or an accumulated load in a predetermined period) may be displayed in place of the torque converter oil temperature gauge G2. Display of the loaded load can be realized such that a hydraulic sensor (not illustrated) detects an oil pressure in each cylinder (8 and 11) and converts the oil pressure into a load value, and the control unit 42 receives data of the load value and transmits the load value data to the display control unit 43.

In addition, if the display region of the first work machine individual information display region 71 in which the monitoring item is displayed is broadened or narrowed according to the operational status of the backhoe loader 1, a monitoring item particularly displayed when a loader work is performed (for example, the torque converter oil temperature gauge G2 or the loaded load as described above) can be displayed with emphasis, and the visibility of the operator can be enhanced by causing the display region of the first work machine individual information display region 71 during traveling in the loader work to be broader than the display region during non-traveling. Meanwhile, in a case where any breakdown is caused when a loader work is performed, the display region of the first work machine individual information display region 71 is narrowed in order to promptly notify the operator of details of the breakdown or a way of dealing with the breakdown, rather than the monitoring item displayed in the first work machine individual information display region 71, whereby the workability and the safety of the operator can be enhanced.

In addition, an icon 10 for selecting the four-wheel steering system in which the steering of the tires of the lower traveling body 2 in the loader 3 is performed with four wheels is displayed at a lower right part of the display screen 81. The backhoe loader 1 operates the steering wheel 25 in usual traveling in a loader work, and can swingably travel by steering the front tires of the vehicle body. The four-wheel steering system is provided and the rear tires of the vehicle body are also steered, whereby traveling with excellent mobility can be achieved. Therefore, the operator can cause the backhoe loader 1 to travel by arbitrarily selecting and setting a phase pattern of the four-wheel steering system (a combination of the steering direction of the tires). As for displaying the first work machine individual information display region 71 in an arbitrary position on the display screen 81, the first work machine individual information display region 71 is displayed in a position at the loader 3 side (anterior to the vehicle body) during a loader work, and the second work machine individual information display region 72 is displayed in a position at the backhoe 4 side (posterior to the vehicle body) during a backhoe work, as described above, whereby the operator can reduce the movement of the view when looking at the displayed individual monitoring items, and the workability can be improved.

Further, FIG. 8 is the display screen 31 when the seat 20 is in the orientation position toward the backhoe 4. On the display screen 81, similarly to FIG. 7, the engine water temperature gauge G1, the fuel level gauge G3, the fuel consumption gauge G4, and the service meter S are displayed as the common monitoring items. In addition, in the second work machine individual information display region 72 in which the individual monitoring items related to the operation state of the backhoe 4 are displayed, an engine speed gauge G5 that indicates the engine speed and an auto deceleration indicator G6 that indicates an execution state of an auto deceleration control to decelerate the engine speed to a predetermined speed are displayed. Note that, similarly to the function of the display screen 81 during a loader work described above, the second work machine individual information display region 72 can broaden or narrow the display region according to the type of the monitoring item to be displayed and the operational status of the backhoe loader 1, and furthermore, can display the display region at any position on the display screen 81.

Note that, as illustrated in FIGS. 7 and 8, the switch panel 41 is provided around the display screen 81. This switch panel 41 includes a plurality of function switches 41*a* to 41*h*. In the switch panel 41, the function switches 41*a* to 41*d* located below the display unit 40 are switches for outputting, to the control unit 42, signals (hereinafter, command signals) corresponding to icons (not illustrates) displayed on the display screen 81 above the respective switches. In addition, in the switch panel 41, the function switches 41*e* to 41*h* located to the right of the display screen 81 are switches for outputting, to the control unit 42, signals (hereinafter, command signals) corresponding to icons displayed on the display screen 81 to the left of the respective switches.

The control unit 42 outputs a necessary control signal to the display control unit 43 when receiving the command signal, and stores information such as a specified value according to the command signal in a storage device such as a memory provided in the control unit 42. Alternatively, the control unit 42 outputs a control signal to the vehicle control controller 50 based on the command signal. The operator or the service person presses these function switches 41*a* to 41*h* to transit the display screen. 81 to another screen (for example, a display screen of past maintenance history information or a setting screen for setting specified values of various types of equipment), or can select or determine various types of setting. Therefore, the display device 35 is provided with such function switches 41*a* to 41*h* along with the display screen 81, display of various types of information and an operation using the display device 35 becomes possible. That is, the display device 35 can function as a non conventional compact information output device having excellent operability and visibility.

Figure 9:
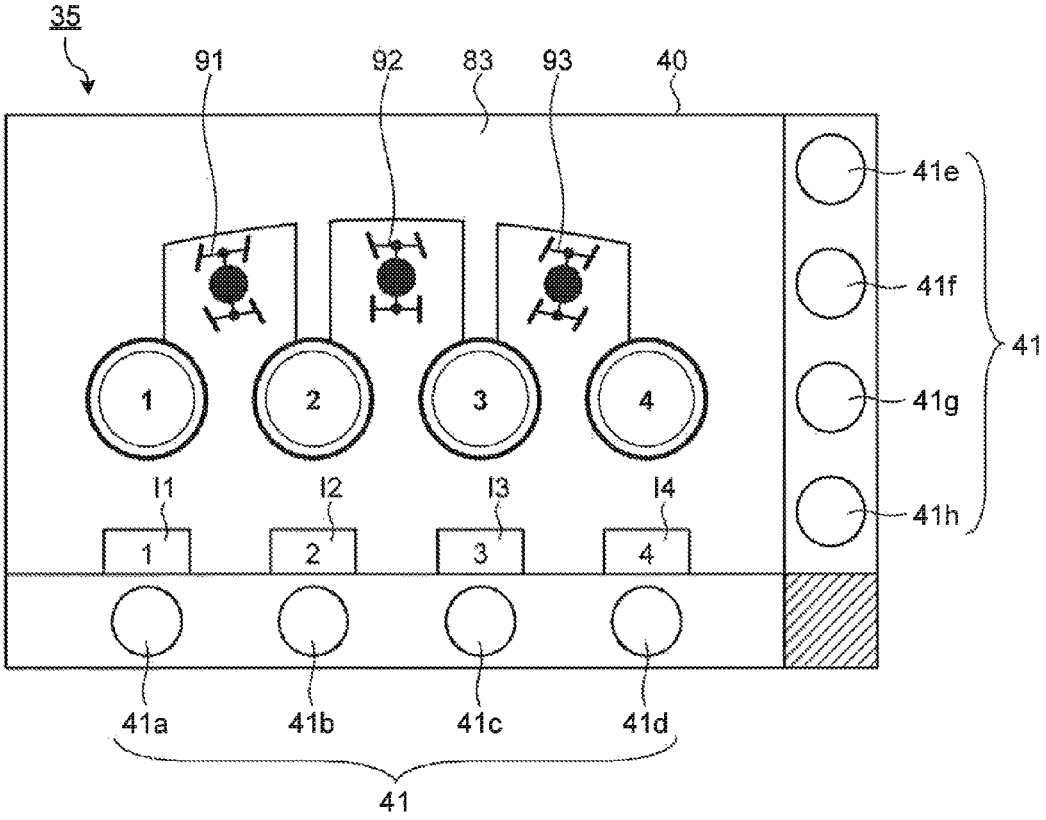
FIG. 9 is a diagram illustrating an example of the display screen of the display device illustrated in FIGS. 2 and 3.
Figure 10:
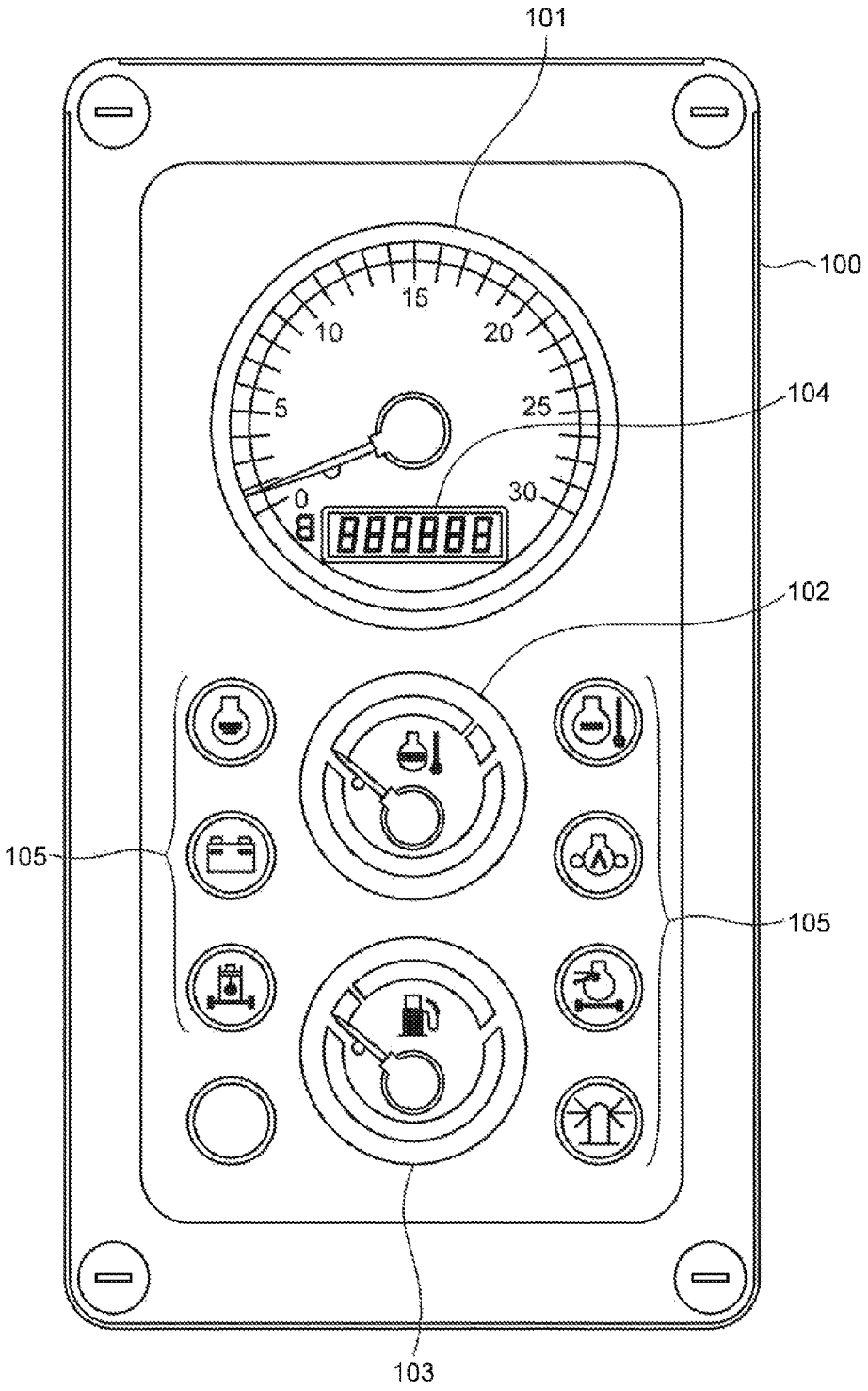
FIG. 10 is a plan view illustrating a pointer-type monitor in a conventional work vehicle.

Here, for example, when the function switch 41*h* corresponding to the icon I0 on the display screen 81 illustrated in FIG. 7 is pressed, the display screen 81 is transited to a 4WS setting screen 83 illustrated in FIG. 9.

As illustrated in FIG. 9, on the 4WS setting screen 83, figure icons I1 to I4 of "1" to "4" respectively are displayed corresponding to the respective function switches 41*a* to 41*d*. In addition, on the 4WS setting screen 83, an icon 91 that indicates a state of "opposite phase" in a four-wheel steering system, an icon 92 that indicates a state of "2WS", an icon 93 that indicates a state of a "coordinate phase", and figures corresponding to the respective figure icons I1 to I4 of "1" to "4" are displayed.

The icons 91 to 93 illustrate the vehicle bodies as viewed from above, where the tires positioned anterior to the vehicle body come upper side of each icon. For example, the icon 92 indicates that the tires positioned anterior to the vehicle body can be steered with the steering wheel 25. Further, for example, in a case where rear wheels are steered into an opposite direction (opposite phase direction) to front wheels, both of the function switches 41*a* and 41*b* corresponding to the icons 11 and 12 are pressed to input an signal, and the vehicle control controller 50 sets the steering directions of the front wheels and the rear wheels of the tires of the lower traveling body 2 to be the opposite phase directions. Note that the 4WS setting screen 83 may be displayed on the display screen 81 in place of the step ST3 illustrated with reference to FIG. 5. That is, when the seat 20 is determined to be in the orientation position toward the loader 3 based on the revolving of the seat 20 (step ST4), the backhoe loader 1 can select a phase pattern of the four-wheel steering system in moving and traveling (a combination of the steering directions of the tires). As illustrated in FIGS. 7 and 8, as the common monitoring items, the engine water temperature gauge G1, the fuel level gauge G3, the fuel consumption gauge G4, and the service meter S are displayed on the 4WS setting screen 83, and the icons 91 to 93 are displayed on the 4WS setting screen 83 as the individual, monitoring items related to the operation state of the loader 3, so that a region in which the icons 91 to 93 are displayed may be used as the first work machine individual information display region 71.

As described above, according to the embodiment of the present invention, in the backhoe loader 1 having a plurality of work machines, various types of information such as the individual monitoring items and the common monitoring items related to the operation states when works are performed with the loader 3 and the backhoe 4 are displayed in the display device 35, and can be accurately and promptly transmitted to the operator with good visibility. Therefore, the operator can execute necessary actions that should be taken according to the various types of information. Further, information indicated by a plurality of instruments is displayed on the display screen of the one compact display device 35, so that the information can be displayed all together in an area, which was conventionally scattered in the driver's cab 6, whereby the operator can promptly, easily, and accurately recognize the information. Further, the one compact display device 35 is provided in the driver's cab 6, so that the residence space for the operator within the driver's cab 6 of the backhoe loader 1 can be enlarged. Furthermore, since the display device 35 is compact, there are fewer obstacles that block the operator's view, and the visibility in overlooking a working site outside the driver's cab 6 is secured, and the workability of the operator can be enhanced.

In addition, in the above-described embodiment, when the seat 20 is in the orientation position toward the loader 3, the torque converter oil temperature gauge G2 is displayed for the loader 3 in the center of the display screen 81; and when the seat 20 is in the orientation position toward the backhoe 4, the engine speed gauge G5 and the auto deceleration indicator G6 are displayed for the backhoe 4 in the center of the display screen 81. However, the present invention is not necessarily limited to the embodiment. When the seat 20 is in the orientation position toward the loader 3, other individual monitoring items related to the operation state of the loader 3 may be displayed; and when the seat 20 is in the orientation position toward the backhoe 4, other individual monitoring items related to the operation state of the backhoe 4 may be displayed.

Further, in the above-described embodiment, the display screen 81 is displayed during revolving of the seat 20. However, the present invention is not necessarily limited to this embodiment. A display screen different from any screen of the display screen 81 illustrated in FIGS. 7 and 8, for example, a display screen that displays content such as "seat revolving" and "please fix the seats" may be displayed during revolving of the seat 20.

Further, in the above-described embodiment, the orientation position is anteriorly or posteriorly changed by revolving the entire seat 20. However, the method of changing the orientation position of the seat 20 is not necessarily limited to the revolving. That is, the seat 20 may be removed to change the anterior/posterior directions, or a fixed seat surface 20*a* of the seat 20 having the backrest 20*b* and the headrest 20*c* that are movable in anterior or posterior direction may be used. In these cases, one or a plurality of sensors, which detects the positions, anterior to or posterior to the vehicle body, of the backrest 20*b* and the headrest 20*c*, is disposed in the driver's cab 6, and the positional information of the orientation position of the seat 20 may be detected with these sensors as the detection information illustrated in FIG. 5.

Further, the above-described embodiment has been described as an application to the backhoe loader 1.

However, the present invention can be applied to other work vehicles. For example, an application to a bulldozer provided with a blade at an anterior part of the vehicle body as toe first work machine and with a ripper at a posterior part of the vehicle body as the second work machine is possible. The operator of the bulldozer sets the orientation position of the seat in an anterior direction of the vehicle body in a dozing work with the blade (works of earth and sand excavation and dozing of earth and sand). In a ripping work with the ripper (works of ground excavation and rock grinding), the operator sets the seat at a position tilted by several degrees with respect to the anterior direction of the vehicle body, and works while looking at the posterior to vehicle body. That is, the seat is set to the position tilted by several degrees in the anterior direction of the vehicle body, so that the operator can easily turn the body in a posterior direction to the vehicle body, whereby the workability of the ripping work is improved. Therefore, in the dozing work by the blade (works of excavation of earth and sand and dozing of earth and sand) and the ripping work with the ripper (works of ground excavation and rock grinding), the individual monitoring items displayed in the display device in the driver's cab are differentiated, the position of the seat in the driver's cab is detected by the sensors and the like, and the display screen of the display device is caused to make a transition according to the detection result. Whereby, the workability of the operator can be improved and the residence space in the driver's cab can be ensured.

REFERENCE SIGNS LIST

1 Backhoe loader
2 Lower traveling body
3 Loader
4 Backhoe
5 Frame part
6 Driver's cab
6*a* Floor
7 Lift arm
8 Lift cylinder
9 Bucket
10 Bell crank
11 Tilt cylinder
12 Tilt rod
13 Boom
14 Arm
15 Bucket
16 Boom cylinder
17 Arm cylinder
18 Bucket cylinder
19 Stabilizer
20 Seat
20*a* Seat surface
20*b* Backrest
20*c* Headrest
20*d* Armrest
20*e* Revolving shaft
21 Revolving part
21*a* First protrusion part
21*b* Second protrusion part
22 Instrument panel
23 Work machine gauge board
24 Traveling operation unit
25 Steering wheel
26 Direction indicating lever
27 Gear shift lever
28 Accelerator pedal
29 Brake pedal
30 Side console
31 Hand brake lever

32 Side console
33 Work machine lever
34 Instrument group
35 Display device
36 Stabilizer operation lever
37 and 38 Work machine lever
39 Pillar
40 Display unit
41 Switch panel
41*a* to 41*h* Function switch
42 Control unit
43 Display control unit
44 Communication line
50 Vehicle control controller
51 First sensor
52 Second sensor
60 Battery
71 First work machine individual information display region
72 Second work machine individual information display region
81 Display screen
83 4WS setting screen
91 to 93 Icon
G1 Engine water temperature gauge
G2 Torque converter oil temperature gauge
G3 Fuel level gauge
G4 Fuel consumption gauge
G5 Engine speed gauge
G6 Auto deceleration indicator
I0 Icon
I1 to I4 Figure icon
K1 Key
S Service meter
SW1 Key switch

The invention claimed is:

1. A work vehicle including a first work machine and a second work machine, comprising:

a seat for which an orientation position toward the first work machine and an orientation position toward the second work machine can be switched;

a seat position detection unit configured to detect the orientation position of the seat;

a display unit configured to display information related to an operation state of the work vehicle; and a control unit configured to change information displayed by the display unit according to the orientation position of the seat detected by the seat position detection unit.

2. The work vehicle according to claim 1, wherein the information displayed by the display unit is individual information that is different between when a work is performed with the first work machine and when a work is performed with the second work machine, and the control unit is configured to switch the individual information according to the orientation position of the seat detected by the seat position detection unit.

3. The work vehicle according to claim 2, wherein the individual information is first individual information related to a work by the first work machine displayed in the display unit when the seat position detection unit detects that the seat is in the orientation position toward the first work machine, or second individual information related to a work by the second work machine displayed in the display unit when the seat position detection unit detects that the seat is in the orientation position toward the second work machine.

4. The work vehicle according to claim 3, wherein, when the orientation position detected by the seat position detection unit is not the orientation position toward the first work machine and is not the orientation position toward the second work machine, the control unit displays, in the display unit, any of the first individual information, the second individual information, and other information different from the first individual information and the second individual information.

5. The work vehicle according to claim 3, wherein at least one of the first individual information and the second individual information is information indicating a physical amount that is changed according to an operation of a power transmission mechanism of the work vehicle, or information indicating a setting state of a steering system of a traveling body included in the work vehicle.

6. The work vehicle according to claim 2, wherein the individual information is displayed in a central part of a display screen that is included in the display unit.

7. The work vehicle according to claim 1, wherein the information displayed by the display unit includes common information displayed in the display unit commonly when a work is performed with the first work machine and when a work is performed with the second work machine.

8. The work vehicle according to claim 1, wherein the seat position detection unit is configured to detect the orientation position of the seat by detecting a revolving position of the seat or a backrest position of the seat.

9. A work vehicle display device comprising:

a display unit configured to display information related to an operation state of a work vehicle in which a first work machine and a second work machine are arranged, the work vehicle including a seat for which an orientation position toward the first work machine and an orientation position toward the second work machine can be switched; and a control unit configured to change information displayed by the display unit according to a seat position detected by a seat position detection unit configured to detect the orientation position of the seat.

10. A method of controlling a work vehicle display device including a display unit configured to display information related to an operation state of a work vehicle in which a first work machine and a second work machine are arranged, the work vehicle including a seat for which an orientation position toward the first work machine and an orientation position toward the second work machine can be switched, the method comprising:

a seat position detection step of detecting the orientation position of the seat; and a control step of changing information displayed by the display unit according to the orientation position detected by the seat position detection step.

11. A backhoe loader provided with a loader and a backhoe, comprising:

a seat for which an orientation position toward the loader and an orientation position toward the backhoe can be switched;

a seat position detection unit configured to detect the orientation position of the seat;

a display unit configured to display information related to an operation state of the backhoe loader; and a control unit configured to change information displayed by the display unit according to the orientation position of the seat detected by the seat position detection unit.

12. A backhoe loader display device comprising:

a display unit configured to display information related to an operation state of a backhoe loader in which a loader and a backhoe are arranged, the backhoe loader including a seat for which an orientation position toward the loader and an orientation position toward the backhoe can be switched, and a control unit configured to change information displayed by the display unit according to a seat position detected by a seat position detection unit configured to detect the orientation position of the seat.

13. A method of controlling a backhoe loader display device including a display unit configured to display information related to an operation state of a backhoe loader in which a loader and a backhoe are arranged, the backhoe loader including a seat for which an orientation position toward the loader and an orientation position toward the backhoe can be switched, the method comprising:

a seat position detection step of detecting the orientation position of the seat; and a control step of changing information displayed by the display unit according to the orientation position detected by the seat position detection step.

* * * * *